US010207529B2

(12) United States Patent
Downing et al.

(10) Patent No.: US 10,207,529 B2
(45) Date of Patent: Feb. 19, 2019

(54) SECURITY ELEMENT OR DOCUMENT WITH A SECURITY FEATURE INCLUDING AT LEAST ONE DYNAMIC-EFFECT FEATURE

(71) Applicants: Elizabeth Anne Downing, Sunnyvale, CA (US); Johannes Georg Schaede, Wurzburg (DE)

(72) Inventors: Elizabeth Anne Downing, Sunnyvale, CA (US); Johannes Georg Schaede, Wurzburg (DE)

( * ) Notice: Subject to any disclaimer, the term of this patent is extended or adjusted under 35 U.S.C. 154(b) by 93 days.

(21) Appl. No.: 13/649,416

(22) Filed: Oct. 11, 2012

(65) Prior Publication Data

US 2013/0093174 A1 Apr. 18, 2013

Related U.S. Application Data

(60) Provisional application No. 61/547,258, filed on Oct. 14, 2011.

(51) Int. Cl.
*B42D 25/30* (2014.01)
*B42D 15/00* (2006.01)
(Continued)

(52) U.S. Cl.
CPC ..... *B42D 25/30* (2014.10); *B42D 15/00* (2013.01); *B42D 25/29* (2014.10); *B42D 25/387* (2014.10); *B42D 2035/24* (2013.01)

(58) Field of Classification Search
CPC ..... B42D 15/00; B42D 15/10; B42D 25/29; B42D 25/387; B42D 2035/24; G09C 3/00
(Continued)

(56) References Cited

U.S. PATENT DOCUMENTS 4,500,116 A * 2/1985 Ferro ..... B42D 25/415 283/92
5,338,067 A * 8/1994 Gundjian ..... G03C 5/08 283/67
(Continued)

FOREIGN PATENT DOCUMENTS

DE 19611363 A1 9/1997
WO 2007005354 A2 1/2007

*Primary Examiner* — Justin V Lewis
(74) *Attorney, Agent, or Firm* — Seager, Tufte & Wickhem LLP

(57) ABSTRACT

There is described a security element or document comprising a substrate (20) and at least a first dynamic-effect feature (100; 120; 121; 122; 123; 130; 135; 140; 150; 171; 181; 191; 200) provided on the substrate which includes a dynamic-effect component that is responsive to illumination stimulus of a selected excitation wavelength or wavelength band to produce an optical spectral response, which optical spectral response changes dynamically over an observable period of time between multiple color appearances (C, F, M; C1, M1) upon and while being subjected to the illumination stimulus. The first dynamic-effect feature is provided in a region of the substrate which is proximate or adjacent to at least one proximity feature (101, 102; 120*a*, 120*b*; 121*a*, 121*b*; 122*a*, 122*b*; 123*a*, 123*b*; 131, 132, 133; 136, 137; 141, 142; 151, 160; 172; 182, 183; 192; 201, 205, 206) provided on the substrate, which at least one proximity feature has a color appearance which is selected to enhance and/or complement at least one of the multiple color appearances of the first dynamic-effect feature.

15 Claims, 15 Drawing Sheets

FIGURE OF MERIT

(51) Int. Cl.
*B42D 25/29* (2014.01)
*B42D 25/387* (2014.01)

(58) Field of Classification Search
USPC ..... 283/67, 70, 72, 74, 91, 93, 94, 98, 109, 283/114, 901
See application file for complete search history.

(56) References Cited

U.S. PATENT DOCUMENTS

| | | | | |
|---|---|---|---|---|
| 6,036,232 | A | 3/2000 | Kaule et al. | |
| 8,110,281 | B2 | 2/2012 | Downing | |
| 2003/0062716 | A1* | 4/2003 | Curiel | G06K 19/077 283/71 |
| 2006/0237541 | A1* | 10/2006 | Downing | C09B 67/0004 235/462.01 |
| 2008/0036196 | A1* | 2/2008 | Steenblik et al. | 283/109 |
| 2010/0314861 | A1* | 12/2010 | Amidror | B42D 25/29 283/85 |

* cited by examiner

SECURITY ELEMENT OR DOCUMENT WITH A SECURITY FEATURE INCLUDING AT LEAST ONE DYNAMIC-EFFECT FEATURE

PREAMBLE/TECHNICAL FIELD

The present invention generally relates to security elements or documents comprising a substrate and at least a first dynamic-effect feature provided on the substrate which includes a dynamic-effect component that is responsive to illumination stimulus of a selected excitation wavelength or wavelength band (in particular but no limited to ultraviolet radiation) to produce an optical spectral response, which optical spectral response changes dynamically over an observable period of time between multiple color appearances upon and while being subjected to the illumination stimulus.

BACKGROUND OF THE INVENTION

Dynamic-effect components (or pigments), hereinafter referred to as "DEPs" (Dynamic Effect Pigments), belong to a class of components that respond to incident excitation light by exhibiting more than one optical color appearance under continuous, uniform illumination with electromagnetic energy. In other words, the optical spectral response of such components is not constant over time, but changes from one color appearance to at least a second, distinct color appearance, typically over an observable period of time of a few seconds. Such DEPs are in particular discussed and disclosed in International Application No. WO 2007/005354 A2 and US Patent Publication No. US 2006/0237541 A1, the content of which is incorporated herein by reference in its entirety.

A particular sub-class of DEPs are self-modulated (or auto-modulated) fluorescent pigments, or SMF (AMF) pigments, namely pigment components that fluoresce under exposure to incident excitation light and whose fluorescent response is modulated over time while being subjected to the incident excitation light. SMF pigments can in particular be based on an adequate combination and arrangement of fluorescent dyes and photochromic dyes, where the photochromic dyes gradually modulate the fluorescence produced by the fluorescent dyes as the photochromic dyes are being activated by the incident excitation light.

DEPs can also be based on suitable combinations of fluorescent and/or phosphorescent dyes with different optical spectral responses and/or response times. Similarly, a dynamically-changing optical spectral response under continuous, steady-state exposure to incident electromagnetic radiation can be created by suitable combinations of different photochromic dyes exhibiting different properties, in particular different response times.

DEPs can be printed, transferred, applied, embedded or otherwise provided onto or into a substrate. Suitable printing processes (in particular intaglio printing, offset printing and silk-screen printing, which printing processes are typically used in the security printing industry), application/transfer processes (such as hot- or cold-stamping techniques), and embedding processes (such as used in the context of the manufacture of cotton-paper substrates) are known per se in the art and can be used to apply DEPs.

In the context of the present invention, the expression "security element" in particular designates any element that can be produced in a form suitable for subsequent provision onto or into substrates of security documents, including transfer elements for transfer onto substrates, such as transferrable foils or patches (similar to so-called Optically Variable Devices, or OVD's, as used for application onto security documents like banknotes), and embeddable elements for incorporation into substrates during the manufacture thereof, such as embeddable threads, fibers or planchettes (as commonly used for the production of security documents like banknotes).

The expression "security document" designates any document having a security value, including but not limited to banknotes, stamps, passports and like identification documents, driving licences, visas, stock certificates, brand protection labels, duty stamps, etc.

The present invention is directed to a number of applications, or usage paradigms, exploiting in an innovative way the properties of DEPs as a security feature for security elements or documents, in particular for the purpose of authenticating such security elements or documents.

SUMMARY OF THE INVENTION

A general aim of the invention is to provide a security element or security document comprising a substrate and a dynamic-effect feature provided on the substrate which includes at least one dynamic-effect component as discussed above, which at least one dynamic-effect component is exploited, in combination with one or more further components, to produce a feature or pattern whose appearance dynamically-changes over time in response to incident electromagnetic radiation in a way that is readily-recognizable by lambda users.

More specifically, an aim of the invention is to provide such a security element or security document which can easily be identified and authenticated without this necessitating complex authentication tools beyond a reasonably simple illumination source, i.e. a security feature usable as a so-called "level-two security feature".

These aims are achieved thanks to the security elements or documents as defined in the appended claims.

There is accordingly provided a security element or document comprising a substrate and at least a first dynamic-effect feature provided on the substrate which includes a dynamic-effect component that is responsive to illumination stimulus of a selected excitation wavelength or wavelength band to produce an optical spectral response, which optical spectral response changes dynamically over an observable period of time between multiple color appearances upon and while being subjected to the illumination stimulus, wherein the first dynamic-effect feature is provided in a region of the substrate which is proximate or adjacent to at least one proximity feature provided on the substrate, which at least one proximity feature has a color appearance which is selected to enhance and/or complement at least one of the multiple color appearances of the first dynamic-effect feature.

According to an advantageous embodiment of the invention, the first dynamic-effect feature has a first color appearance under ambient visible light, a second color appearance upon initial submission to the illumination stimulus, and at least a third color appearance upon continued steady-state submission to the illumination stimulus. In this context, it is of particular interest to make use of a self-modulated fluorescent (SMF) component as the dynamic-effect component, preferably such a component that reversibly returns from its modulated color appearance to its contrast color appearance after a given recovery time following cessation of the illumination stimulus.

The illumination stimulus preferably consists of incident electromagnetic radiation in the ultraviolet (UV) or infrared (IR) spectrum.

According to one embodiment of the invention, the at least one proximity feature has a static color appearance that does not change in response to the illumination stimulus, which static color appearance is selected to be similar or to closely match at least one of the multiple color appearances of the first dynamic-effect feature. Different variants of this embodiment are disclosed.

According to another embodiment of the invention, the at least one proximity feature is selected to have a color appearance which is similar to or closely matches at least one of the multiple color appearances of the first dynamic-effect feature. In this context, one, two, three (or even more) proximity features could be provided, each having a color appearance that is similar to or closely matches a different one of the multiple color appearances of the first dynamic-effect feature. Different variants of this embodiment are disclosed, including variants where the first dynamic-effect feature is of the type having a first color appearance under ambient visible light, a second color appearance upon initial submission to the illumination stimulus, and at least a third color appearance upon continued steady-state submission to the illumination stimulus.

According to a further embodiment of the invention, the first dynamic-effect feature has a transitory fluorescent color appearance upon initial submission to the illumination stimulus, and the at least one proximity feature is a static fluorescent feature including a static fluorescent component, which static fluorescent component has a static fluorescent color appearance upon initial and continued steady-state submission to the illumination stimulus. The static fluorescent color appearance of the static fluorescent feature can in particular be selected to be similar to or closely match the transitory fluorescent color appearance of the first dynamic-effect feature. Variants of this other embodiment are disclosed including variants allowing for the concealment of a predetermined pattern under ambient visible light, which predetermined pattern only becomes visible upon submission to the illumination stimulus.

According to yet another embodiment of the invention, the at least one proximity feature is a second dynamic-effect feature including a dynamic-effect component that is also responsive to the illumination stimulus to produce a dynamically-changing optical spectral response with multiple color appearances, and the dynamically-changing optical spectral responses of the first and second dynamic-effect features differ in their color appearances and/or response times. Variants of this additional embodiment in particular allow for the generation of more complex features and patterns which dynamically change in appearance under exposure to the illumination stimulus.

There is further provided a method of checking the authenticity of the above security elements or documents, comprising the following steps:

- subjecting the security element or document to the illumination stimulus, and
- observing the optical spectral response of the security element or document in response to the illumination stimulus.

Advantageous embodiments of the above security elements or documents form the subject-matter of the dependent claims.

BRIEF DESCRIPTION OF THE DRAWINGS

Other features and advantages of the present invention will appear more clearly from reading the following detailed description of embodiments of the invention which are presented solely by way of non-restrictive examples and illustrated by the attached drawings in which.

DETAILED DESCRIPTION OF EMBODIMENTS OF THE INVENTION

Figure 1:
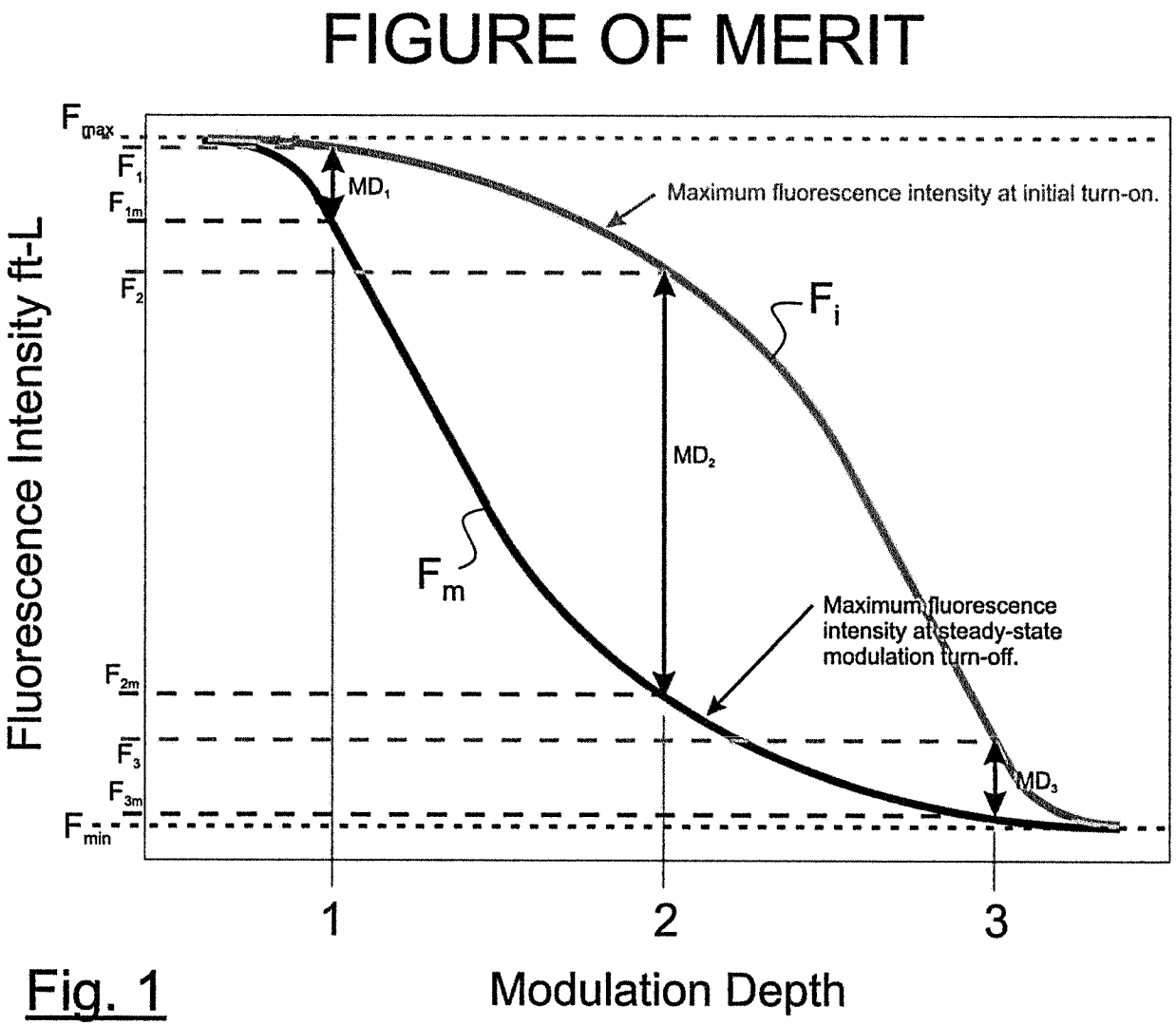
FIG. 1 is a "figure of merit" illustrating the modulation principle of SMF pigments, a sub-class of DEPs which is advantageously usable in the context of the present invention.

The various implementations discussed hereinafter are mainly based on the use of at least one dynamic-effect feature in combination with one or more proximity features to produce a pattern whose appearance dynamically-changes over time in response to incident electromagnetic radiation in a way that is readily-recognizable by lambda users, i.e. without this necessitating complex authentication tools beyond a reasonably simple illumination source. In other words, the various embodiments discussed hereinafter can suitably be used as so-called "level-two security features" for security documents.

A "dynamic-effect feature" is to be understood as referring to a feature provided on a substrate and including at least one dynamic-effect component, such as at least one DEP or SMF pigment, that is responsive to illumination stimulus of a selected excitation wavelength or wavelength band to produce an optical spectral response, which optical spectral response changes dynamically over an observable period of time between multiple color appearances upon and while being subjected to the illumination stimulus.

A "proximity feature" is to be understood as referring to a feature provided on the substrate and having at least one color appearance and which is located proximate to or adjacent to the dynamic-effect feature. In the context of the present invention, such proximity feature or features have a color appearance which is selected to enhance and/or complement at least one of the multiple color appearances of the dynamic-effect features. Various embodiments will be discussed in the following description.

As DEPs are quite novel and new, there is yet no formalized color theory for how to fully describe their usage and effects. For static, or traditional pigment however, (i) the Munsell color system, first published in 1905, provides a model for objectively measuring color. In this model, color is described in three dimensions, hue, value (lightness) and chroma (color purity). Other color systems which provide various means to describe color are known, such as (ii) the CIE tri-stimulus color space model, created by the International Commission on Illumination in 1931, which provides three wavelength-dependent color specifications, (iii) the RGB color system, which is based on the additive primary colors red, green and blue, and (iv) the HSV and HSL models described by Alvy Ray Smith in 1978, which define colors in terms of (hue, saturation, value) and (hue, saturation, lightness), respectively. All of these systems and others like them, however, define color with a set of time-invariant parameters. Pigments, colorants, dyes, dispersions of pigments and colors, solutions of dyes, and other colored systems and objects, are, by association, specified in terms of their static color in some color models.

In extreme contrast to traditional colorants and pigments, DEPs have multiple sets of hue, value, and saturation, which can be used to describe the various color appearances that they can elicit. These sets of parameters vary in time, generally over a short enough period of time, that an observer can readily detect a change in color parameters. As a cursory example, a pigment that starts out red in ambient white light, then changes to green under some stimulus, and then further changes to brown under the same stimulus a few seconds later, would by definition be a DEP. If this pigment changes back to red when the stimulus is suppressed, it can be regarded as a reversible or recoverable DEP. If the pigment remains in one of its transitioned colors when the stimulus is removed, then it can be regarded as an irreversible or permanent DEP. In the context of the present invention, while reversible DEPs are preferred, irreversible DEPs can also be used and accordingly fall within the realm of this invention.

The following description discloses a number of implementation modalities and usage paradigms that help enhance the appearance of the effect in applications such as when printed on paper using inks and coatings as binders. It is to be appreciated again however, that the following implementations could equally be realized by means of application processes other than by printing, for instance by incorporation into or onto elements that are then applied onto or embedded into a substrate.

A preferred embodiment of a DEP that is contemplated in the context of the present invention, and which has already been briefly discussed above, is a so-called SMF (Self-Modulated Fluorescent) pigment. An SMF pigment has multiple color appearances as a function of time when viewed in visible (white) light and subsequently excited with a constant level and intensity of electromagnetic radiation, in particular UV illumination. Such pigments have a first, contrast, color (C), which can be viewed in ambient light, followed by a second, fluorescent color (F), also viewable in white light (but triggered by the exciting illumination), followed by a third, modulation color (M), which is viewable in the same white light, the color-gamut of which the pigment transitions through within a few seconds, thereby providing a readily-observable dynamic appearance to a viewer. In terms of color specification this can be presented as SMF[C, F, M], where C, F and M can all have independent and different hue, value, and saturation values as defined by any suitable color model or color system.

In addition, these parameters occur or evolve relative to one another as a function of time, with varying time constants associated with the transitions from one appearance to another, and can subsequently recover to their original color (C) (in the case of reversible SMF pigments). A Self-Modulating Fluorescent pigment with an initial contrast color C, upon illumination with the proper electromagnetic stimulus (e.g. UV light), will initially fluoresce to its fluorescent color F, then transition to the third modulation color M with a time constant $\tau_1$. The modulation color M will be stable in appearance as long as the electromagnetic stimulus is present at the same intensity level. When this stimulus is removed, the pigment gradually recovers back to its original color C with a time constant $\tau_2$. Thus, an SMF pigment of this nature, considered as a homogeneous material, has at least five parameters associated with it, namely SMF[C, F, M, $\tau_1$, $\tau_2$].

In addition to these variables, there is also the relative initial instantaneous brightness of the fluorescence, and the degree to which the modulation reduces it, as this reduction does not have to be to absolute zero fluorescence. FIG. 1 hereof identifies a "Figure of Merit" (FOM) to describe the relative difference between the fluorescence of an SMF pigment at initial turn-on ($F_i$), relative to the fluorescence at steady-state modulation to a lower lever ($F_m$). This relative difference can be termed as relative "modulation depth" (MD) of the effect. The relative modulation depth can be specified mathematically using any standard modulation depth equation such as:

$$MD=(F_i-F_m)/(F_{max}-F_{min}) \quad [1]$$

where $F_{max}$ is the maximum fluorescence that can be obtained by the particle with no modulation, and $F_{min}$ is the minimum fluorescence that can be obtained by the particle with no modulation. The modulation depth MD could however be defined in any other suitable way.

In other words, an SMF pigment can be represented by at least the following parameters, namely SMF[C, F, M, $\tau_1$, $\tau_2$, MD]. FIG. 1, illustrates how an SMF pigment can have different degrees of modulation $MD_1$, $MD_2$, $MD_3$, etc., depending on the formulation of the pigment.

SMF pigment systems are described in US Patent Publication No. US 2006/0237541 A1 and International Publication No. WO 2007/005354 A2.

Figure 2:
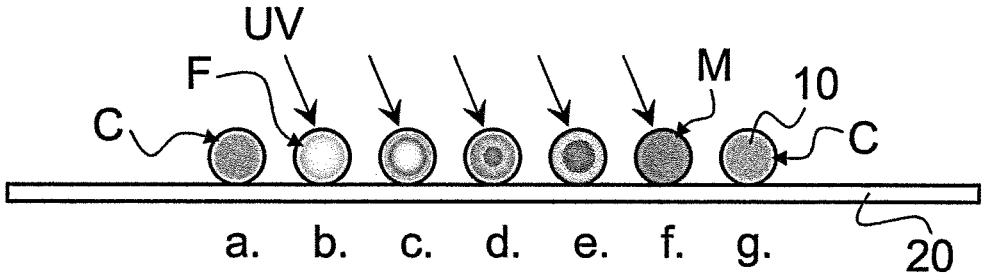
FIG. 2 is a schematic illustration of a single SMF pigment particle under various successive illumination conditions a. through g., namely under ambient visible (i.e. white) light (states a. and g.) and successive states under initial and continuous, steady-state exposure to an illumination stimulus (states b. to f.)

FIG. 2 schematically illustrates a single reversible SMF pigment particle under various successive illumination conditions a. through g. The same particle is shown in all instances a. through g., in ambient visible (white) light (state a.), different successive states with increasing fluorescence modulation (states b. to f.) upon initial and under continuous, steady-state exposure to excitation light (e.g. UV light). State g. illustrates the particle under ambient white light after the particle has returned to its original state. In states a. and g., the particle exhibits its contrast color C, for instance an ochre color. Upon initial exposure to excitation light (while also still being illuminated with ambient white light), the particle turns into its initial fluorescent state (shown at state b.) and exhibits its fluorescent color F, for instance a green fluorescent color. The fluorescence then decreases gradually over time (typically within about two seconds) as schematically illustrated by states c. through e. until it reaches its final modulated state shown at state f. (i.e. after response time $\tau_1$) and exhibits its modulation color M, for instance a dark gray color. Following removal of the excitation light, the SMF particle returns to its original state g. (i.e. after recovery time $\tau_2$).

In the illustration of FIG. 2, the appearance of the particle at state f. shows the pigment particle in a full off condition, with very little fluorescence still emanating from the particle. In this case, the modulation depth of the on/off effect, as it transitions from state b. to state f., is high. The modulation depth can be given quantitatively in units of brightness such as foot-lamberts, or as a percentage of the final brightness of the fluorescent effect, under a constant excitation intensity, relative to the initial brightness.

This particle can recover to its initial color appearance C, after the excitation has been removed. The time constant ($\tau_2$) for this is typically of the order of a few seconds to several tens of seconds, or even to several years depending on the desired application of the SMF pigment.

In the above illustrative example, the designation for the SMF pigment can be SMF[ochre, green, gray, 2, 20, 80], where ochre is the contrast color C, green is the fluorescent color F, gray is the modulation color M, 2 and 20 are the modulation off and recovery time constants $\tau_1$, $\tau_2$ in seconds, and 80 is the percentage of the initial fluorescence that is eliminated by the modulation effect of the pigment.

Figure 3:
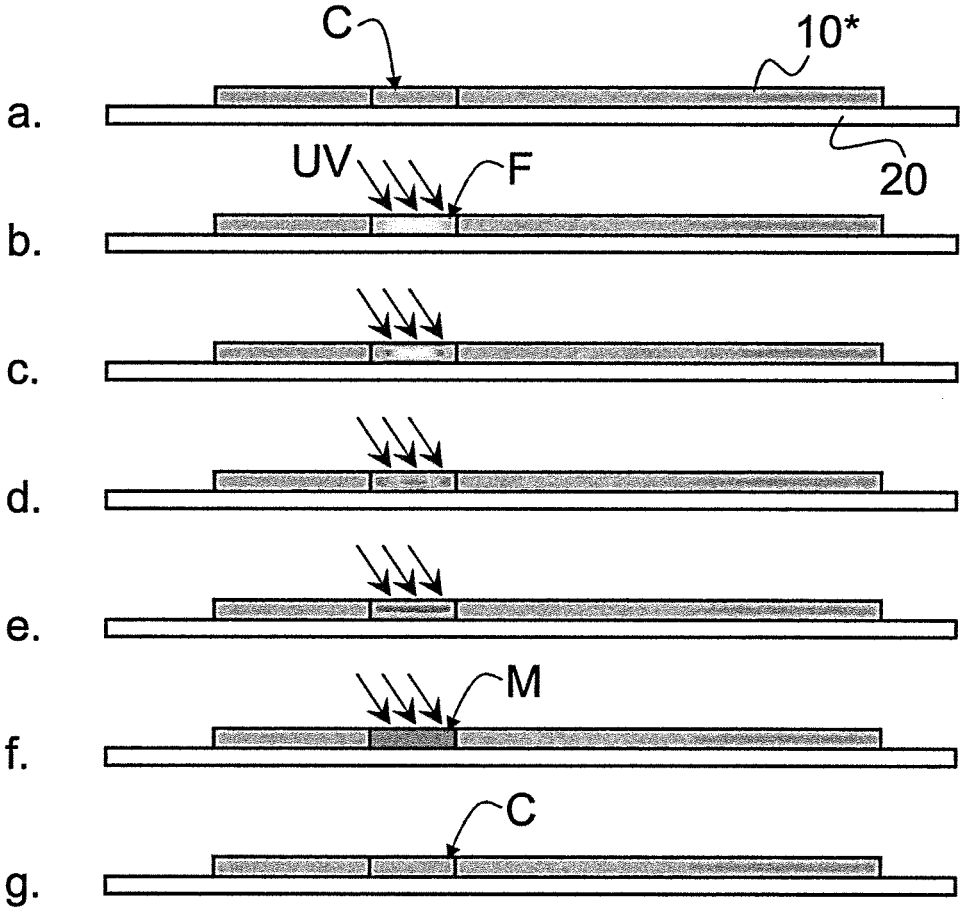
FIG. 3 is a schematic illustration, similar to that of FIG. 2, where the dynamic-effect component (in this case an SMF pigment) was first incorporated into a binder or like ink or varnish vehicle and then applied, for instance by printing, onto a substrate.

FIG. 3 schematically illustrates the effect of an SMF pigment (similar to the SMF pigment discussed in reference to FIG. 2) that has been integrated into a binder and applied to a substrate. The region where the pigment/binder has been applied to the substrate has the first appearance of the contrast color C (e.g. ochre) when viewed in ambient white light (state a.). When excited with the proper stimulus (e.g. UV light), the stimulated region fluoresces instantaneously in the green (state b.), then modulates the fluorescence off (states c. to e.) and transitions to gray (state f.) in about two seconds. The stimulated region recovers to the initial contrast color (state g.) in about twenty seconds when the stimulus is removed.

Figure 4:
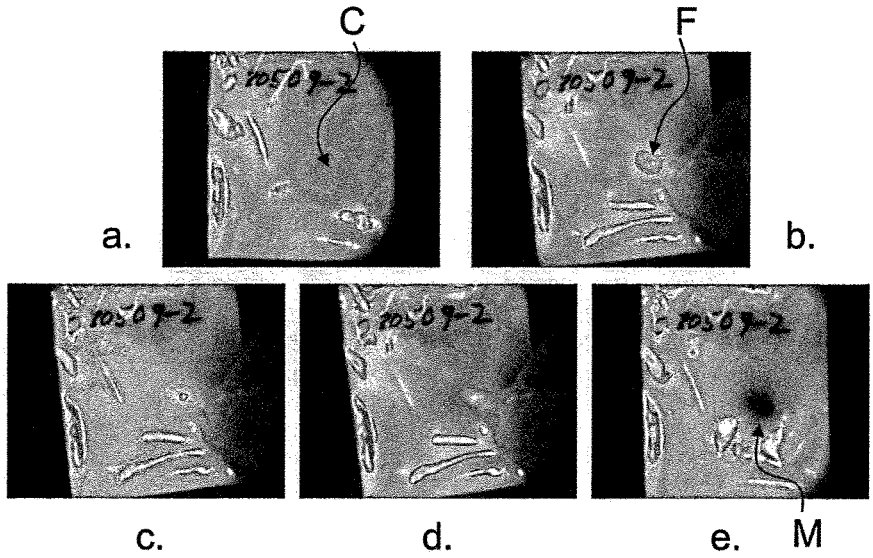
FIG. 4 shows a series of photographs of an SMF pigment in raw form in a plastic bag and under various illumination conditions a. through e., namely under ambient visible light (state a.), upon initial, local, exposure to incident electromagnetic radiation (using e.g. a small UV lamp—state b.), under continued, steady-state exposure to the illumination stimulus (modulated states c. and d.), and upon cessation of the exposure to the illumination stimulus (modulated state e.)

FIG. 4 shows a series of photographs of an SMF pigment in raw form in a plastic bag. The SMF pigment can be seen in its initial form (picture a.), upon instantaneous fluorescence initiated by a small UV lamp (picture b.), then as the fluorescence is gradually modulated off under the same intensity of light (pictures c. and d.). The modulation typically takes about two to three seconds to reach its steady state value. When the UV excitation is suppressed, the gray modulation color typically remains for about twenty to thirty seconds, illustrating that the recovery time constant is not instantaneous.

Figure 5:
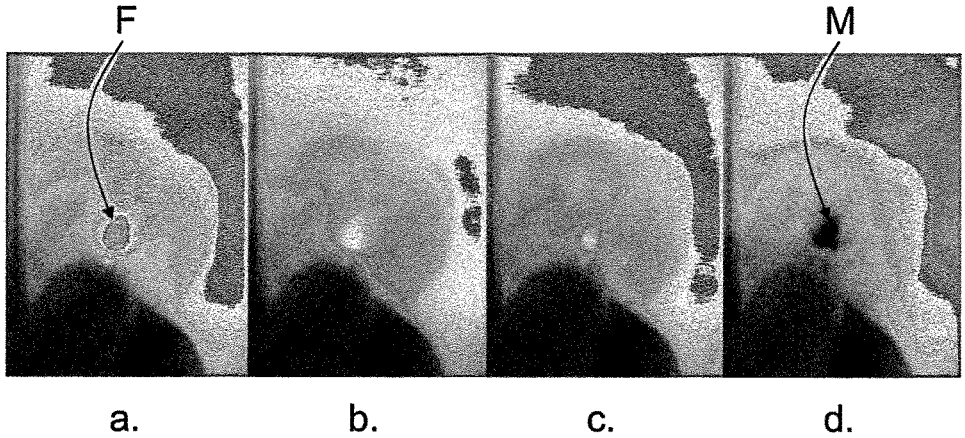
FIG. 5 shows a series of photographs similarly showing the dynamically-changing optical spectral response of an SMF pigment which was incorporated into a binder and then applied on a substrate.
Figure 6A:
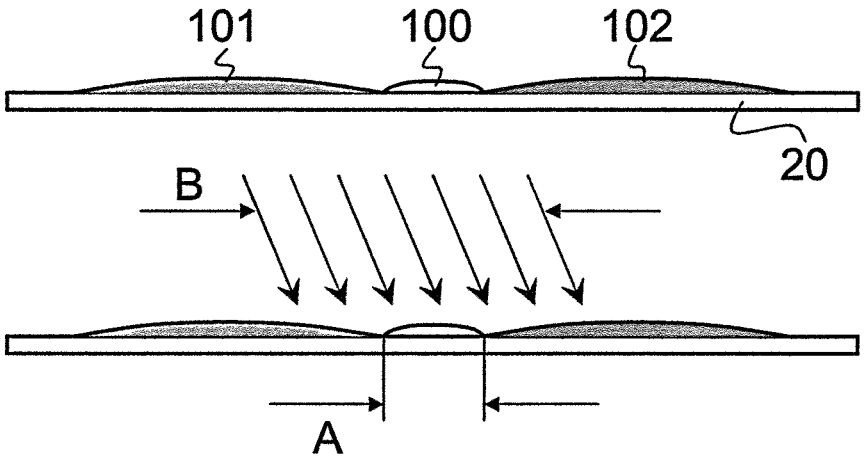
FIGS. 6*a* to 6*c* illustrate a possible interrogation or authentication methodology, in accordance with the invention, where at least one dynamic-effect feature is applied proximate or adjacent to at least one, in this example two proximity features, having respective color appearances that are similar to or closely match different ones of the color appearances of the dynamic-effect feature.
Figure 6B:
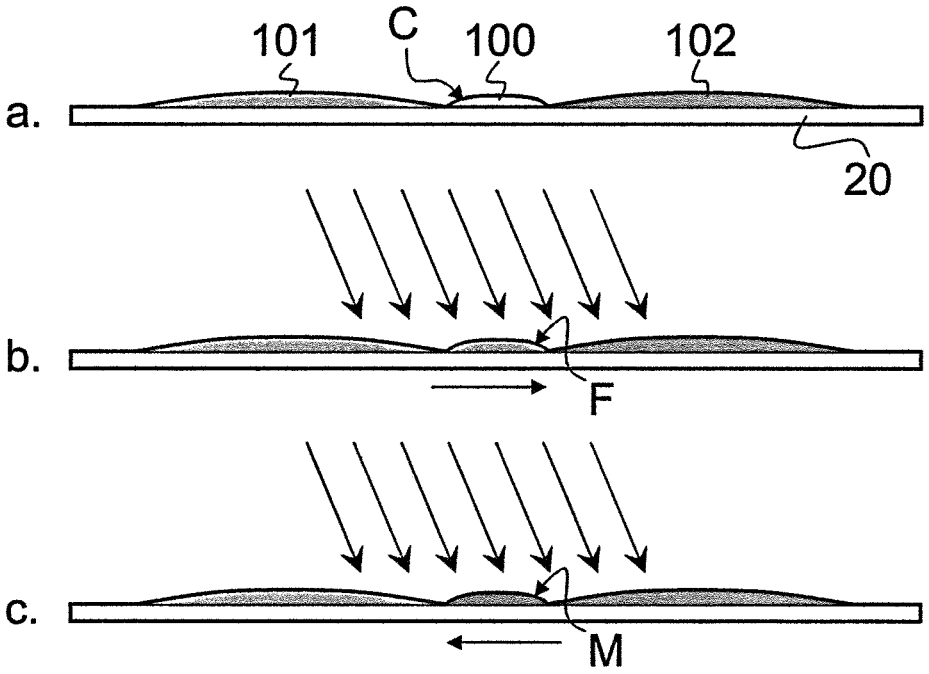
Figure 6C:
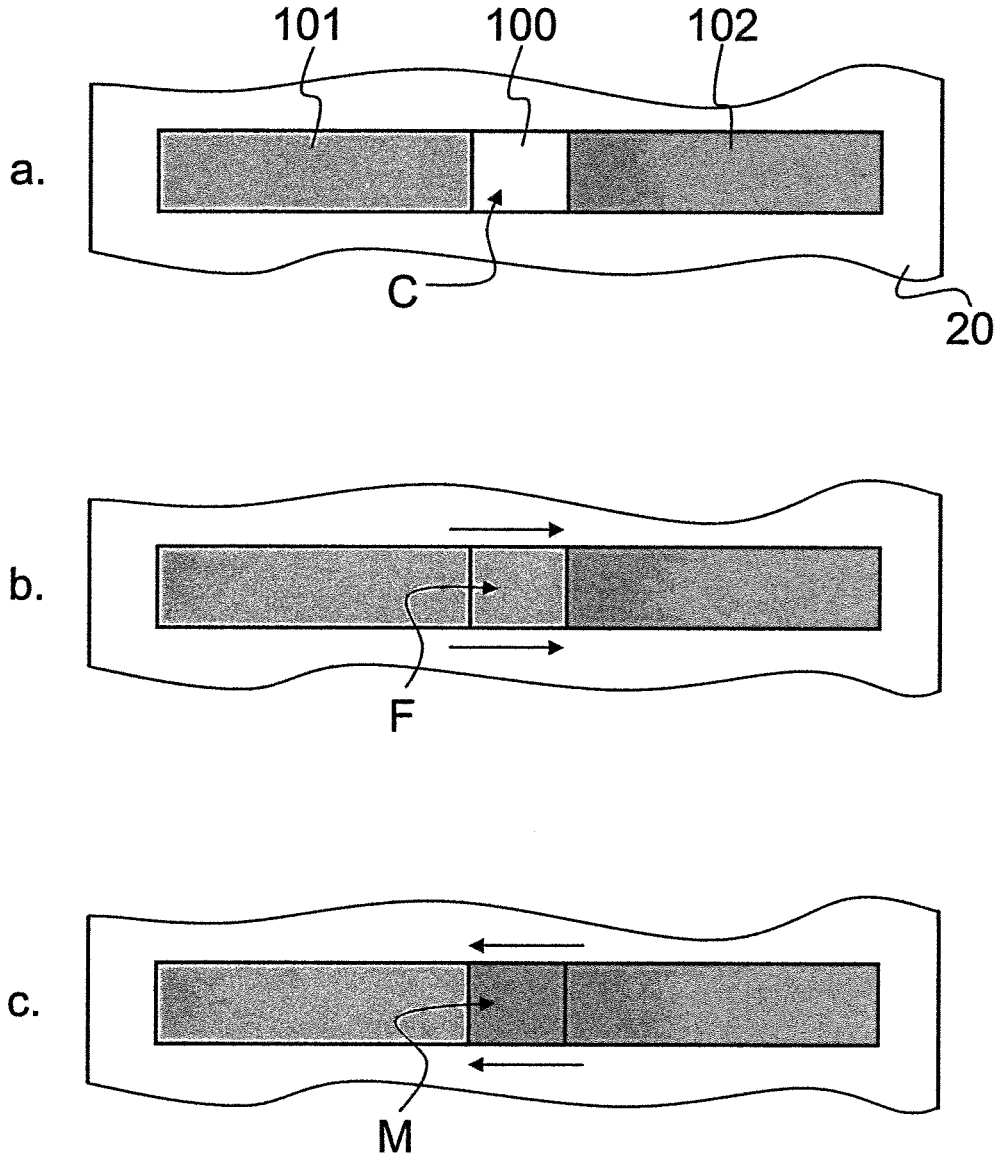

FIG. 5 shows the same effect as described in FIG. 4, but in a pigment that has been integrated into a binder and applied to a substrate. The printed effect of the pigment is substantially the same as described in the raw pigment form.

DEPs, such as the above-described SMF pigments, can be printed on, applied to, or integrated into a variety of substrates, including but not limited to paper or plastic substrates. Their effects can be readily viewed and observed under the requisite illumination conditions. Their effects can be enhanced through judicious usage paradigms and creative selection of colors and features in their proximity as this will be described hereinafter. Proximity colors and proximity features are those that are close enough to the dynamic-effect component that the pigment effect can be seen relative to them, enabling a dynamic comparison to be made as the DEP feature transitions through its phases and/or colors. In that respect, according to the invention, the region where the selected dynamic-effect component is applied can be located adjacent to the proximity colors/features (see FIGS. 6*a*-6*c*, 8*a*-8*d*, 9*a*, 9*b*, 10, 11) or in close proximity (see FIGS. 12 to 15).

In addition to the use of proximity colors/features, the interrogation methodology can also be used to enhance and exploit certain attributes of the DEPs. One such interrogation methodology assumes that the area being subjected to the illumination stimulus at a given point in time is larger than the area where the dynamic-effect component is applied and located (as for instance illustrated in FIGS. 6*a*-6*c*). In other words, the dynamic-effect feature (region 100 in FIGS. 6*a*-6*c*) is smaller in surface area (area A in FIG. 6*a*) than the area (area B in FIG. 6*a*) being illuminated at a given point in time. In this case, the proximity color(s)/feature(s) is(are) formed by regions (such as regions 101 and 102 in FIGS. 6*a*-6*c*) located proximate or adjacent to the region where the dynamic-effect component is applied.

Such interrogation methodology could in particular make use of a large-area illumination source adapted to illuminate the entire area of interest, which large-area illumination source is already typically in use in the art to interrogate banknotes and like security documents. A benefit of this interrogation methodology is that it can be seen on its entire perimeter relative to other proximity colors, and it undergoes a uniform change even if the excitation source is dithered by a small amplitude. Such dithering of the effective excitation source can result from slight movements of the hand if either the illuminator or the substrate is hand-held.

Figure 7A:
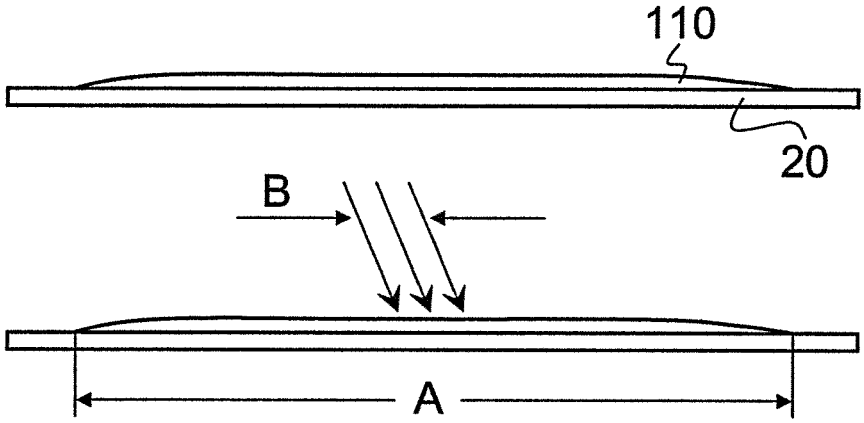
FIGS. 7*a* to 7*c* illustrate another possible interrogation or authentication methodology, in accordance with the invention, where at least one dynamic-effect feature is applied in a region having a larger surface area than the area that is being excited at a given point in time.
Figure 7B:
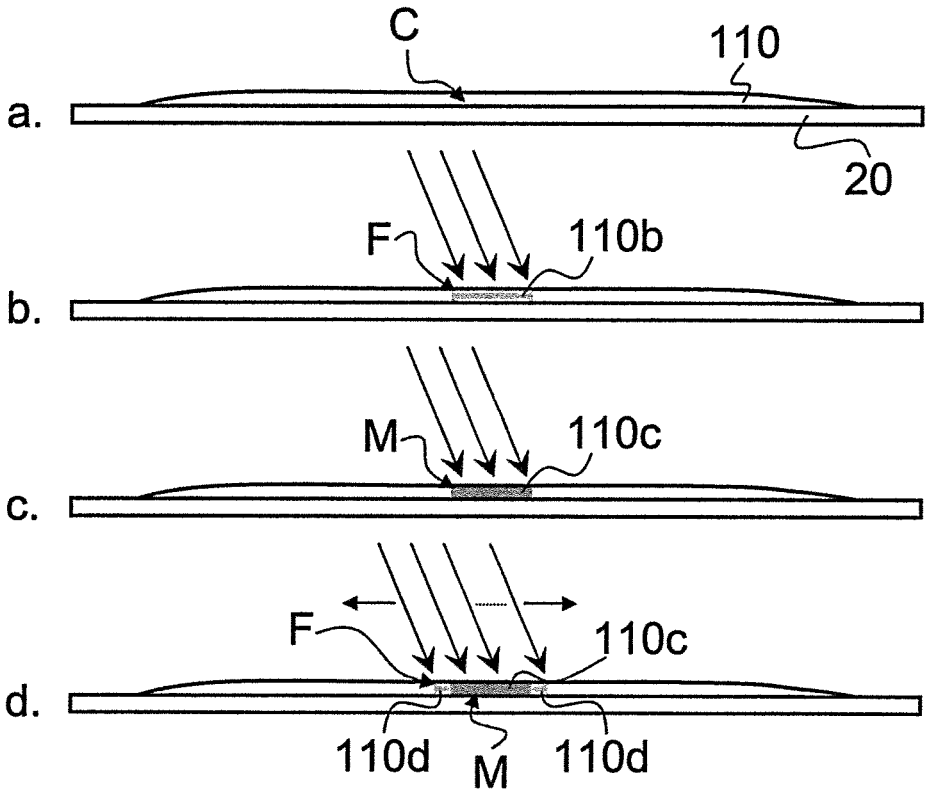
Figure 7C:
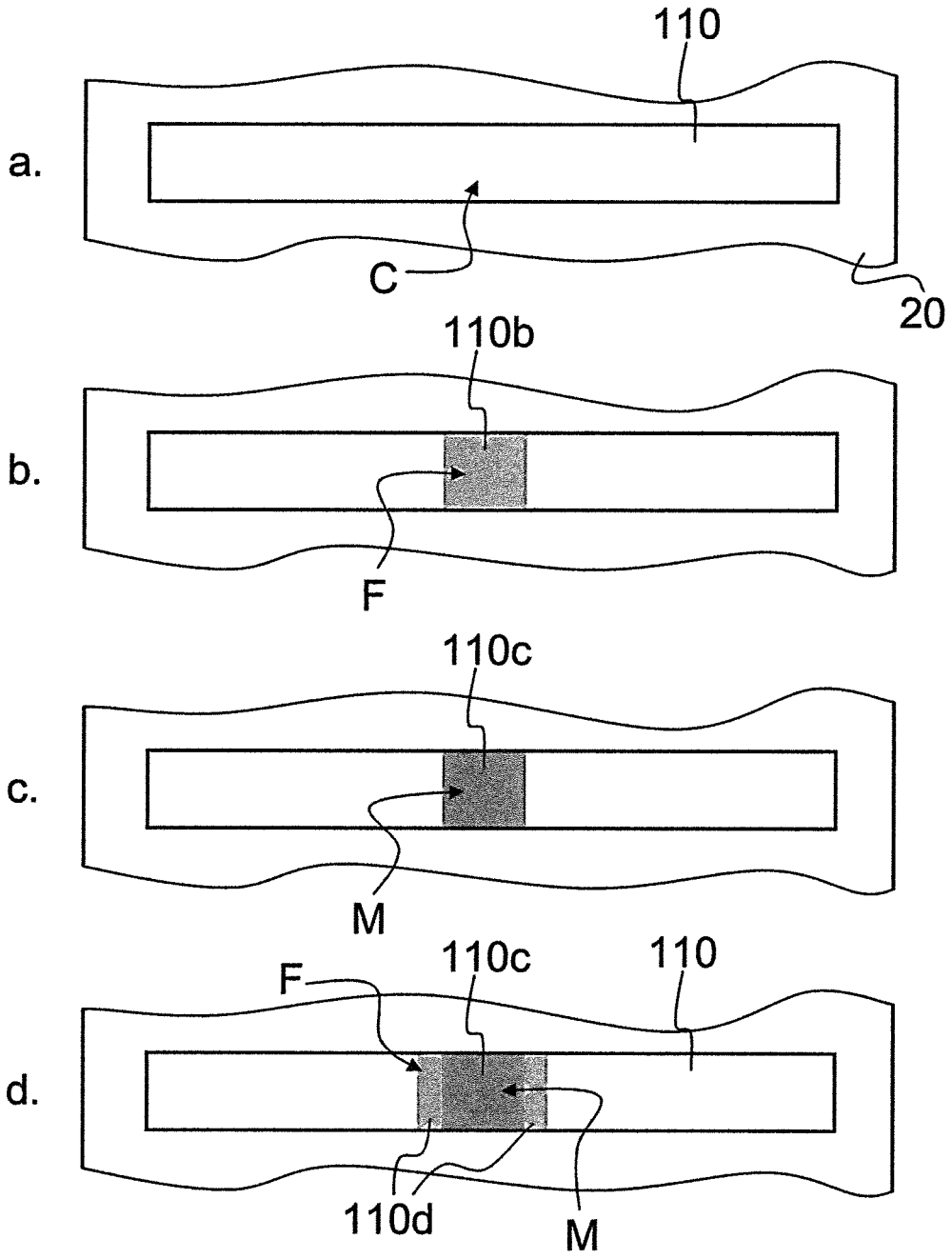

Another interrogation methodology assumes that the area being subjected to the illumination stimulus at a given point in time is smaller than the area where the dynamic-effect component is applied and located (as for instance illustrated in FIGS. 7*a*-7*c*). In other words, the dynamic-effect feature (region 110 in FIGS. 7*a*-7*c*) is larger in surface area (area A in FIG. 7*a*) than the area (area B in FIG. 7*a*) being illuminated at a given point in time. In this latter case, the proximity color(s)/feature(s) is(are) formed by adjacent regions where the dynamic-effect component is applied and which are not being excited.

This other interrogation methodology could in particular make use of small illumination sources, such as LED (Light-Emitting-Diode) devices as for instance shown in FIGS. 4 and 5, which are only adapted to illuminate a localized area. In contrast to the previous interrogation methodology, dithering, or small, localized movement of the illumination source relative to the feature where the dynamic-effect component is applied can be used to continuously induce fluorescence around the edges of the region where the fluorescence has already been modulated to the steady-state off condition and the color has been changed to the modulation color M (as schematically illustrated in FIGS. 7*b* and 7*c*). As long as the illumination source is incident on any portion of the feature 110 for only a short period of time ($t \ll \tau_1$), only fluorescence will be elicited from the feature upon stimulation, as the modulation will not have had sufficient time to modulate the fluorescence down to the steady-state level. Thus dithering of the excitation source can be effectively employed to create a dynamic proximity feature using the fluorescent color F, which is different from either the contrast color C, or the modulation color M, after steady-state modulation of the effect has occurred.

FIGS. 6*a*-6*c* and 7*a*-7*c* illustrate small and large dynamic-effect features relative to the illumination source, and highlight how the interrogation methodologies can be used to further enhance the dynamic effect of any particular DEP feature, such as an SMF feature.

Turning to FIGS. 8*a* to 8*d*, various embodiments are shown which are all based on the provision of a dynamic-effect feature on the substrate where a dynamic-effect component is applied, which dynamic-effect feature is proximate or adjacent (in this case immediately adjacent) to first and second proximity features provided on the substrate, which proximity features have respective color appearances that are similar to or closely match at least one of the multiple color appearances of the dynamic-effect feature. More precisely, the embodiments shown in FIGS. 8*a* to 8*d* all comprises three features forming concentring circles, the central and external regions forming the proximity features and having static color appearances, while the intermediate circle region forms the dynamic-effect feature and comprises at least one dynamic-effect component, so as to exhibit a dynamically-changing optical spectral response in response to an illumination stimulus. In these preferred examples, the dynamic-effect feature comprises at least a self-modulated fluorescent component exhibiting a contrast color appearance C under ambient visible white light (state a. in FIGS. 8*a* to 8*d*), a fluorescent color appearance F upon initial submission to the illumination stimulus (state b. in FIGS. 8*a* to 8*d*), and a modulated color appearance M upon continued steady-state submission to the illumination stimulus (state c. in FIGS. 8*a* to 8*d*).

As shown in FIGS. 8*a* to 8*d*, various effects can be created by playing with the color appearances of the proximity features adjacent (or proximate as the case may be) to the dynamic-effect feature.

Figure 8A:
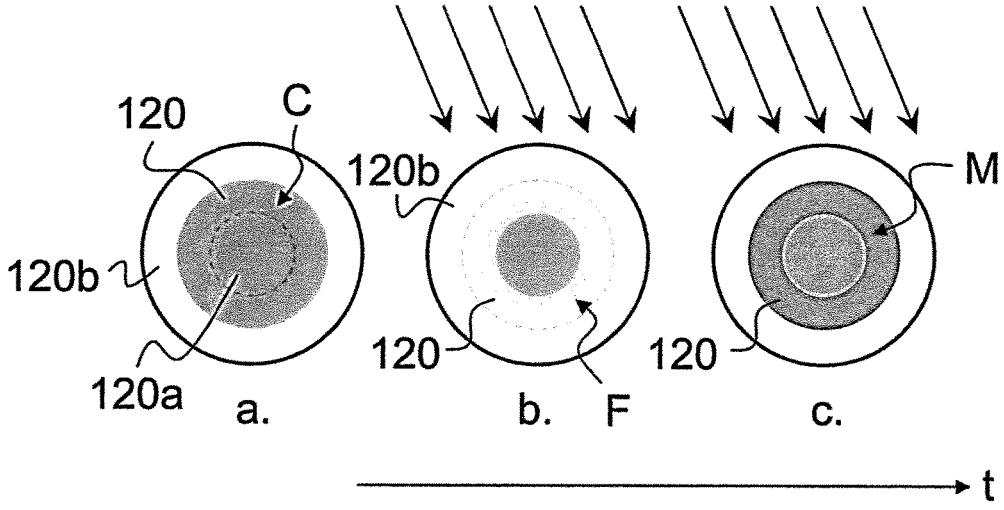
FIGS. 8*a* to 8*d* illustrate embodiments of a security feature in accordance with the invention where a dynamic-effect feature is applied proximate or adjacent to two proximity features in the form of concentric circles, at least one of the proximity features having a color appearance that closely matches or is similar to one of the color appearances of the dynamic-effect feature.

In the illustration of FIG. 8*a*, the proximity color of the central region 120*a* is selected to be similar to or match the contrast color C of the dynamic-effect feature in region 120, while the proximity color of the external region 120*b* is selected to be similar to or match the fluorescent color F of the dynamic-effect feature in region 120.

Figure 8B:
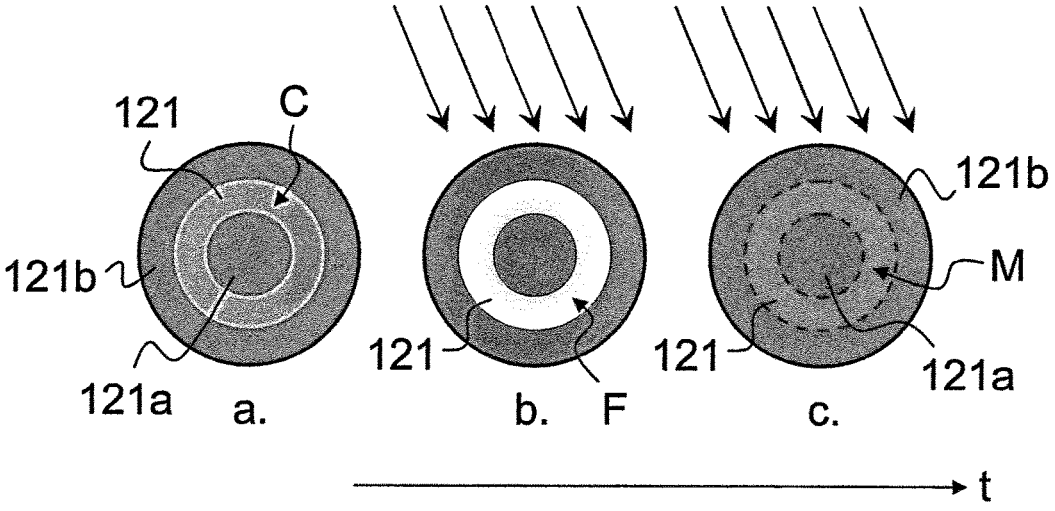

In the illustration of FIG. 8*b*, the proximity colors of both the central and external regions 121*a* and 121*b* are selected to be similar to or match the modulation color M of the dynamic-effect feature in region 121.

Figure 8C:
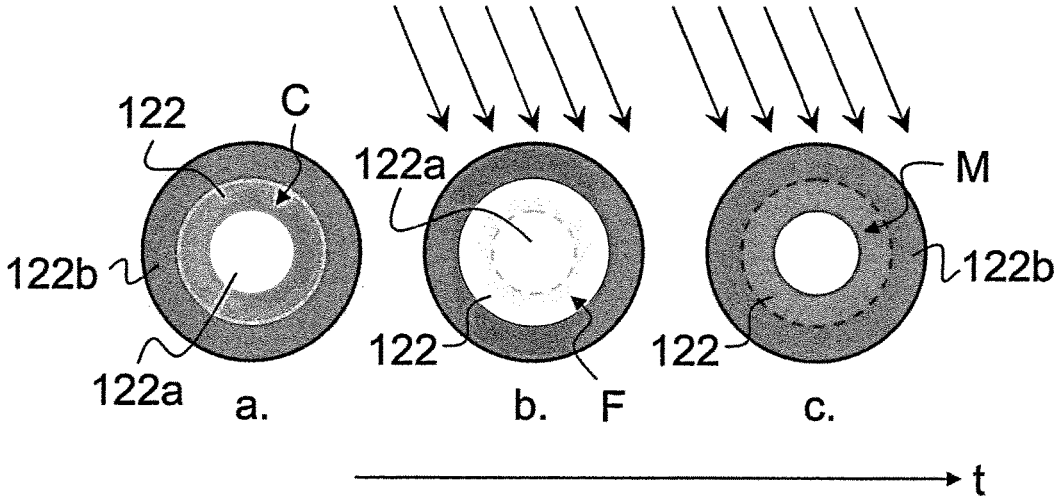

In the illustration of FIG. 8*c*, the proximity color of the central region 122*a* is selected to be similar to or match the fluorescent color F of the dynamic-effect feature in region 122, while the proximity color of the external region 122*b* is selected to be similar to or match the modulation color M of the dynamic-effect feature in region 122.

Figure 8D:
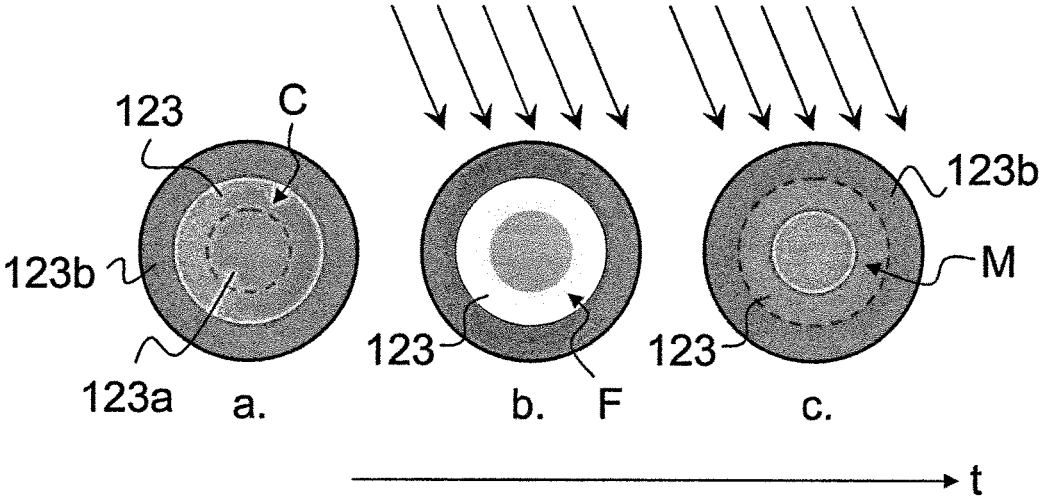

In the illustration of FIG. 8*d*, the proximity color of the central region 123*a* is selected to be similar to or match the contrast color C of the dynamic-effect feature in region 123, while the proximity color of the external region 123*b* is selected to be similar to or match the modulation color M of the dynamic-effect feature in region 123.

A variety of dynamic effects can thus be produced by playing with the color appearances of the proximity features to match any of the color appearances of the dynamic-effect feature.

By playing with the hue of the dynamic colors of the dynamic-effect feature and of the proximity colors of the proximity features, it is also possible to substantially conceal the dynamic-effect feature under ambient visible light, before submission to the illumination stimulus (as for instance shown in FIG. 8*a* or 8*d*). This may be desirable to do for some applications where the dynamic-effect feature is intended to be obscured or concealed under normal illumination conditions for security and/or artistic purposes.

Similarly, opting for a proximity color that matches the, for instance, dark-hued color appearance of the dynamic-effect feature in its modulated-off state, will lead to a reduced contrast between the dynamic-effect feature and the proximity color(s) (as for instance shown in FIGS. 8*b*, 8*c* and 8*d*), giving the impression of a relatively short burst of fluorescence upon submission of the feature to the illumination stimulus.

Other combinations are obviously possible, it being in particular understood that, in the case of an SMF feature, the color appearance of the feature gradually transitions from the fluorescent color F to the modulation color M, meaning that either one of the proximity colors could be selected to match any one of the transition states between the fluorescent color F and the modulation color M of the SMF feature.

The dynamic-effect feature, defined as the region where the DEP (e.g. SMF) pigment has been printed or otherwise applied to the substrate, can take various forms regardless of whether the proximity features are light, dark, or medium hued. This feature can be small so that the illumination source covers it fully when the feature is illuminated (as already discussed in relation to FIGS. 6*a*-6*c* hereof), or it can be larger than the area excited by the illumination source at a given point in time so that the dynamic effect occurs somewhere within the dynamic-effect feature (as already discussed in relation to FIGS. 7*a*-7*c* hereof). In either case, the transition of the pigment can be enhanced relative to one or more proximity colors that do not change under the stimulating conditions.

A particularly effective usage paradigm involving proximity colors includes respective proximity colors that each match a corresponding one of the transition colors of the dynamic-effect component. In the particular case of an SMF feature with transition colors C, F, M as discussed above, such proximity colors could in particular include one proximity color that closely matches the contrast color C of the SMF feature, one proximity color that closely matches the fluorescent color F of the SMF feature, and/or one proximity color that closely matches the modulation color M of the SMF feature, any combination being possible.

In such case, the dynamic-effect feature starts out from one color, and then appears to grow to match another color, momentarily, while the effect is in progress. This apparent growth of the feature to fill the combined dynamic-effect feature/proximity feature union is very effective when the dynamic-effect feature is smaller than the area being stimulated by the illumination source, so that the entire dynamic-effect feature takes on at least one of the transition colors of the dynamic-effect component.

Figure 9A:
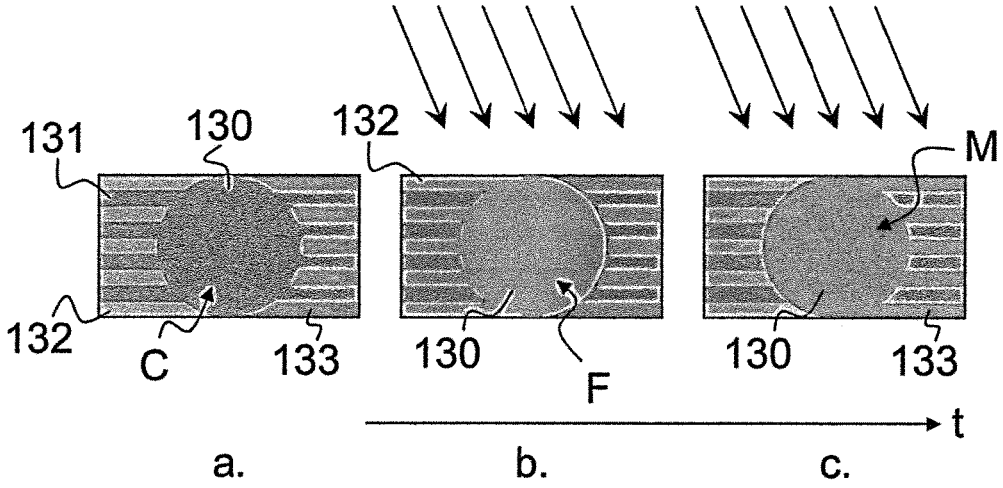
FIGS. 9*a* and 9*b* illustrate two further embodiments of a security feature in accordance with the invention where a dynamic-effect feature is applied proximate or adjacent to multiple proximity features in the form of stripes with respective color appearances that closely match or are similar to different ones of the color appearances of the dynamic-effect feature.

A possible example is shown in FIG. 9*a* where the dynamic-effect feature (here comprising an SMF pigment) is applied in a region 130 (taking the shape of a disk in the illustration) adjacent to three proximity features 131, 132, 133 (here taking the shape of stripes) each having a static proximity color matching a respective one of the contrast color C, fluorescent color F and modulation color M of the SMF feature. Under ambient white light (state a. in FIG. 9*a*), the color appearance of the SMF feature matches that of the lines 131 and, upon submission to the illumination stimulus, initially changes to its fluorescent color appearance to match the color appearance of the lines 132 (state b. in FIG. 9*a*), and then gradually changes as the fluorescence is being modulated to match the color appearance of the lines 133 (state c. in FIG. 9*a*). This embodiment will produce a similar impression of movement, under exposure to the illumination stimulus, between the second and third proximity features 132, 133, as in the case illustrated in FIGS. 6*a*-6*c*.

In a special case, the modulation color M of the SMF feature can be chosen to match or to be similar to the contrast color C. In such an embodiment, the dynamic-effect feature will transition from the contrast color C to the fluorescent color F, then back to the contrast color again as the fluorescence is modulated. When the modulation color closely matches the contrast color, the feature will appear to undergo a momentary fluorescent pulse under continuous stimulation with incident electromagnetic excitation.

Figure 9B:
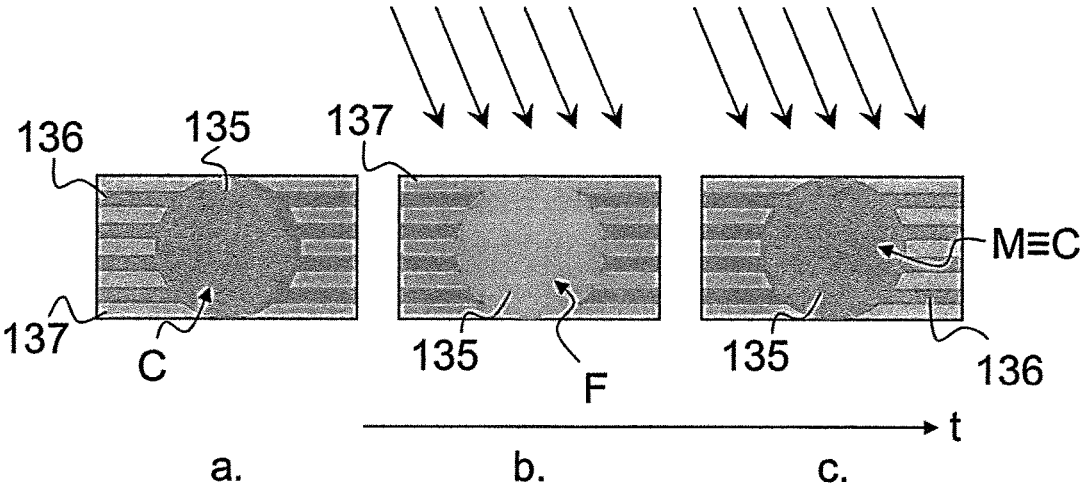

This special case is illustrated in FIG. 9*b*, where the dynamic-effect feature is applied in a region 135 (again taking the shape of a disk) adjacent to proximity features 136, 137 (again taking the shape of stripes) each having a static proximity color matching a respective one of the contrast color C and fluorescent color F.

Another embodiment includes integrating a dynamic-effect component, having a transitory fluorescent response, next to a proximity feature that fluoresces under the same illumination stimulus that induces the dynamic-effect in the dynamic-effect feature, however with a static fluorescent response. Here the fluorescent color of the proximity feature can be the same as the transitory fluorescent color of the dynamic-effect feature (but not necessarily). SMF components are again of particular interest in this context. Thanks to such a combination, the portion of the feature being provided with the static, non-modulating fluorescent component will glow for the duration of the illumination stimulus, at a constant emission level. In contrast, the SMF feature will glow initially, but then modulate off, providing a distinction between the static fluorescent region and the self-modulating fluorescent region. When the excitation source is suppressed, the static fluorescent region will cease to glow, but the modulated region will retain some of its modulated color for the recovery time constant $\tau_2$.

Figure 10:
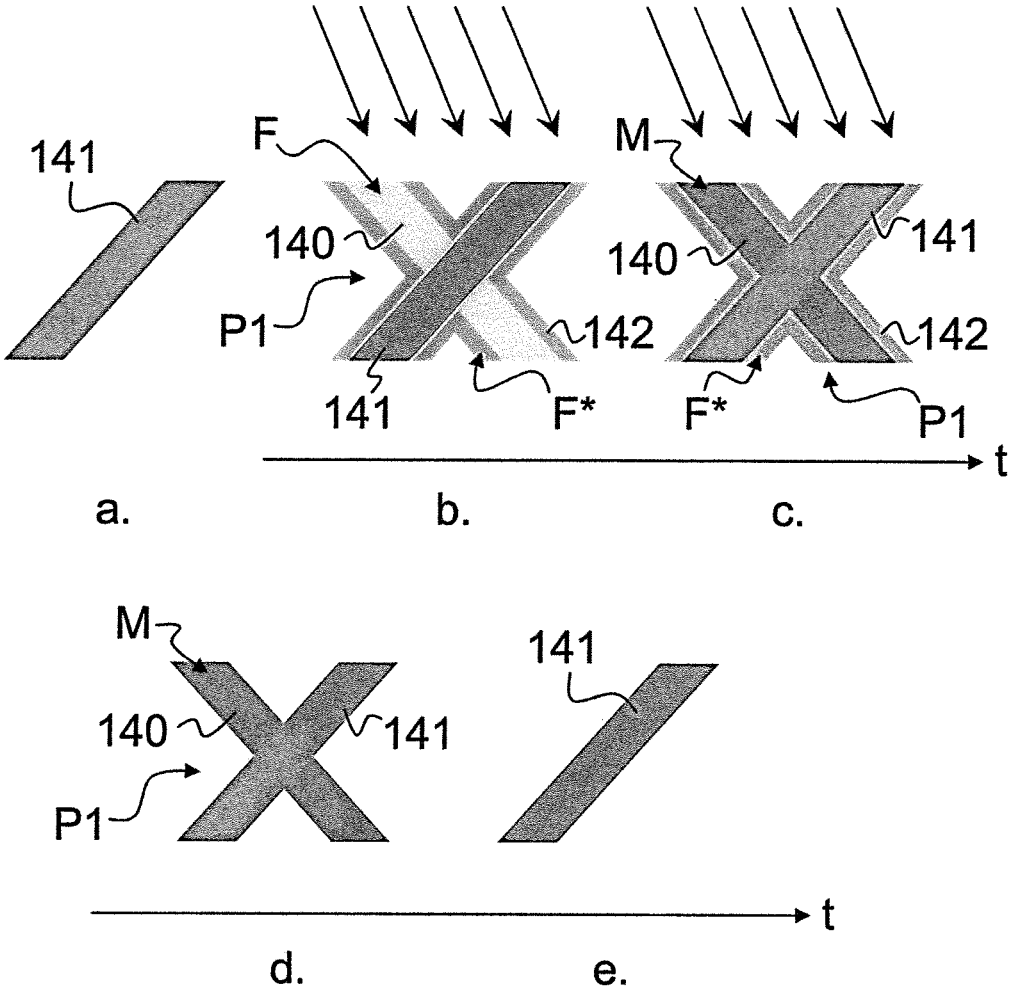
FIG. 10 illustrates yet another embodiment of a security feature in accordance with the invention where a dynamic-effect feature having a transitory fluorescent color appearance upon initial submission to the illumination stimulus is applied in a region of the substrate which is proximate or adjacent to a proximity feature, or static fluorescent feature, having a static fluorescent component, which static fluorescent component has a static fluorescent color appearance upon initial and continued, steady-state submission to the illumination stimulus.

FIG. 10 illustrates this effect with a feature forming a predetermined pattern P1, namely an "X". In this example, a portion of the "X" (designated as region 141 in FIG. 10) exhibits a static color appearance which is preferably selected to match the modulation color M of the SMF feature, another, complementary portion of the "X" (designated as region 140 in FIG. 10) comprising the SMF component. In this example, the contrast color C of the SMF feature is advantageously selected to be white or very light hued, so as to substantially conceal the SMF feature under ambient visible light. For the sake of illustration the SMF component could have the following parameters: SMF [white, green, gray, $\tau_1$, $\tau_2$, 90]. In addition, an additional region 142 is formed next to regions 140, 141, which additional region 142 comprises a static fluorescent component exhibiting a fluorescent color F* upon being subjected to the illumination stimulus. In the illustration of FIG. 10, this additional region 142 advantageously forms an outline around at least part of the regions 140, 141.

As shown in FIG. 10, the resulting pattern will first appear as a single line or bar formed by the proximity color of region 141 (state a. in FIG. 10), will then change to a pattern (state b. in FIG. 10) where regions 140 and 142 are made to fluoresce with their respective fluorescent colors F and F* (which may match one another), and will gradually change to a pattern (state c. in FIG. 10) where region 140 is being modulated off while regions 142 continues to fluoresce. Upon suppression of the excitation (state d. in FIG. 10), region 142 stops fluorescing, while region 140 initially retains its residual modulation color M. As time passes, region 140 reversibly returns to its original state such that only region 141 remains visible (state e. in FIG. 10).

In addition to being subtly integrated with proximity features and static colors, DEPs can be applied with multiple proximity colors in a wide range of features. In particular, features can be produced in the form of line segments with alternate regions comprising a dynamic-effect component and regions comprising only static color components, such that portions of the line segments will exhibit a dynamically-changing optical spectral response, contrasting with the static response of the remaining portions of the line segments.

Figure 11:
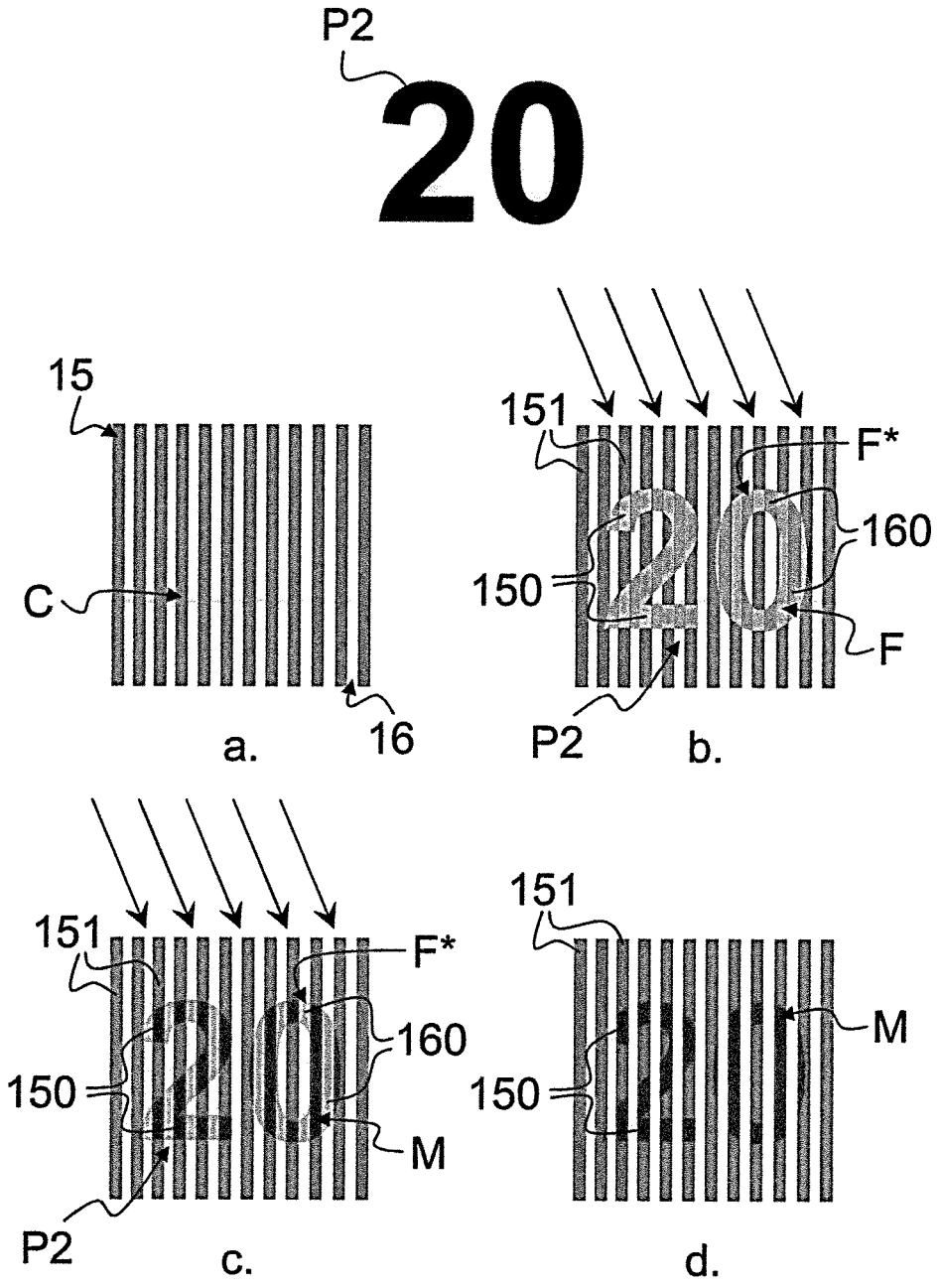
FIG. 11 illustrates another embodiment of a security feature in accordance with the invention, embodying a principle similar to that shown in FIG. 10, where first and second sets of stripes are interlaced, the first set of stripes comprising dynamic-effect features having a transitory fluorescent color appearance and the second set of stripes comprising static fluorescent features having a static fluorescent color appearance, and wherein the stripes are designed in such a way as to conceal information (number "20" in this example) under ambient visible light.

Such a principle is put in use in the embodiment illustrated in FIG. 11. This Figure shows a feature formed using alternating line segments 15, 16, where some line segments 15 are made of regions 150 comprising at least one dynamic-effect component having a transitory fluorescent response interlaced with regions 151 having only a static color component, and where some line segments 16 include regions 160 comprising a static fluorescent component having a static fluorescent component.

In this particular example, the line segments 15, 16 are interlaced and the respective features 150, 160 are arranged in such a way as to form a predetermined pattern P2 (in this case the number "20"). In addition, the dynamic-effect component is selected in this example to be an SMF component whose contrast color C is chosen to closely match the proximity color of the static, inactive portions 151 of the line segments 15, thereby concealing the dynamic, active regions 150 under ambient white light. Similarly, the static fluorescent component is selected to be substantially white or very light hued in its inactive state, such as to substantially conceal the active regions 160 under ambient white light. In such case, the overall appearance of the feature under ambient visible light (state a. in FIG. 11) does not immediately reveal the presence of any particular pattern in the design itself.

Upon initial submission to the incident electromagnetic radiation (state b. in FIG. 11), the predetermined pattern P2 is instantaneously revealed by regions 150 and 160 which start to fluoresce with their respective fluorescent colors F and F* (which could be the same or different). Under continued, steady-state exposure to the illumination stimulus (state c. in FIG. 11), regions 150 forming the predetermined pattern P2 are modulated off to turn into their modulation color M, while regions 160 continue to glow, producing a readily recognizable overall change in appearance of the pattern P2. Upon removal of the excitation (state d. in FIG. 11), regions 160 stop fluorescing, leaving only a residual, partial representation of the predetermined pattern P2 formed by regions 150 which initially retain their modulation color M before returning to the initial contrast color C after the relevant recovery time $\tau_2$.

Figure 12:
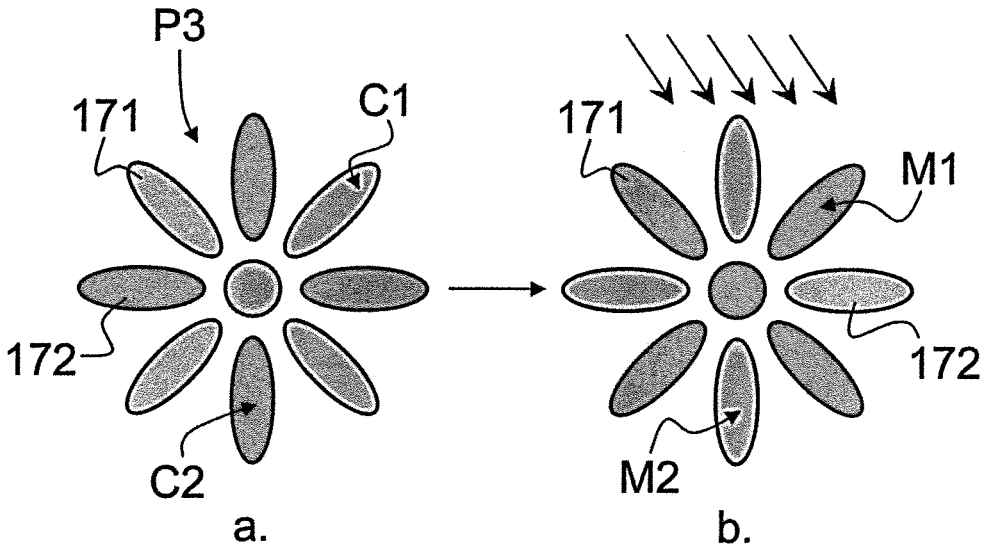
FIG. 12 illustrates still another embodiment of a security feature in accordance with the invention where first and second dynamic-effect features are applied in corresponding proximate or adjacent regions and wherein the dynamically-changing optical spectral responses of the first and second dynamic-effect features differ such that the resulting appearance of the pattern formed by the dynamic-effect features produces the impression of a color swap under exposure to the illumination stimulus.

FIG. 12 illustrates another embodiment of a security feature in accordance with the invention where first and second dynamic-effect features 171, 172 are applied in corresponding proximate (or adjacent) regions and wherein the dynamically-changing optical spectral responses of the first and second dynamic-effect features differ such that the resulting appearance of the pattern formed by the dynamic-effect features produces the impression of a color swap under exposure to the illumination stimulus. In this particular example, the dynamic-effect features 171, 172 jointly form a predetermined pattern P3, taking the shape of a flower in this illustration, where the first dynamic-effect feature 171 changes from its contrast color C1 under ambient visible light to a modulated color M1 following exposure to the illumination stimulus, which modulated color M1 is selected to be similar to or closely match the contrast color C2 of the second dynamic-effect feature 172. Similarly, the second dynamic-effect feature 172 changes from its contrast color C2 under ambient visible light to a modulated color M2 following exposure to the illumination stimulus, which modulated color M2 is selected to be similar to or closely match the contrast color C1 of the first dynamic-effect feature 171.

SMF pigments could be used in the context of this embodiment, it being however understood that one may also use DEPs having no momentary fluorescent appearance upon initial submission to the illumination stimulus.

Figure 13:
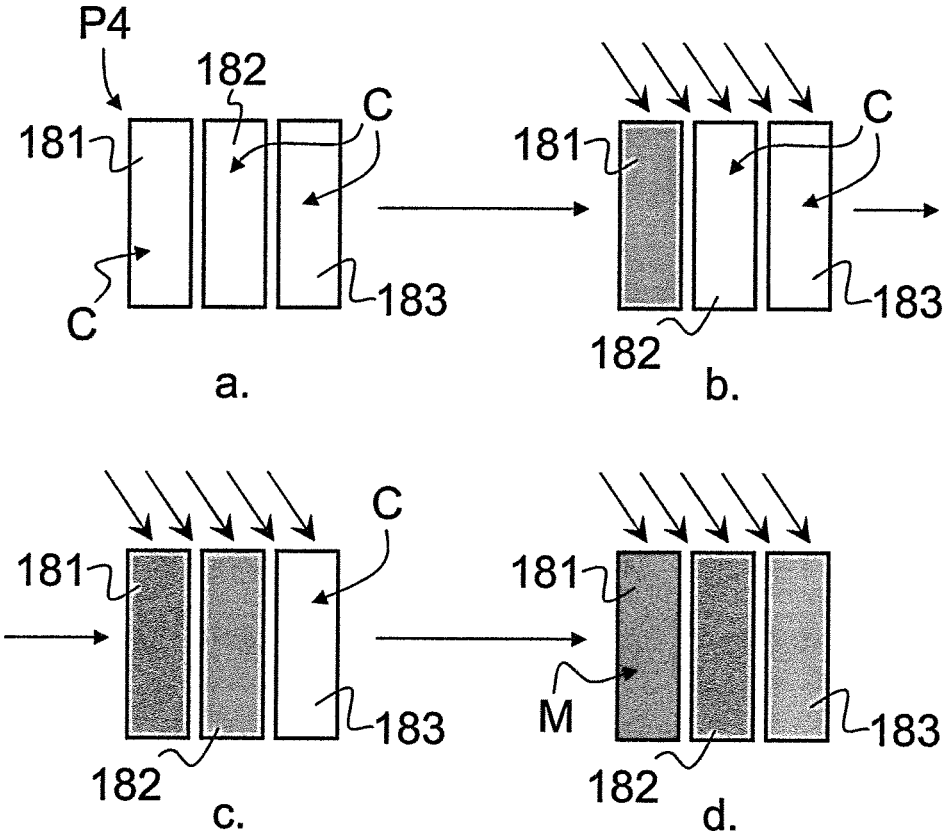
FIG. 13 illustrates still a further embodiment of a security feature in accordance with the invention where three dynamic-effect features having different response times are applied in corresponding proximate or adjacent regions of the substrate such that the resulting appearance of the pattern formed by the dynamic-effect features produces the impression of a gradual change under exposure to the illumination stimulus.

FIG. 13 illustrates a further embodiment of a security feature in accordance with the invention where three dynamic-effect features 181, 182, 183 having different response times are applied in corresponding proximate or adjacent regions of the substrate such that the resulting appearance of the pattern formed by the dynamic-effect features produces the impression of a gradual change under exposure to the illumination stimulus. The pattern P4 formed by the dynamic-effect features 181, 182, 183 here consists of simple bar elements that enhance the dynamically-changing effects of the various dynamic-effect components.

Figure 14:
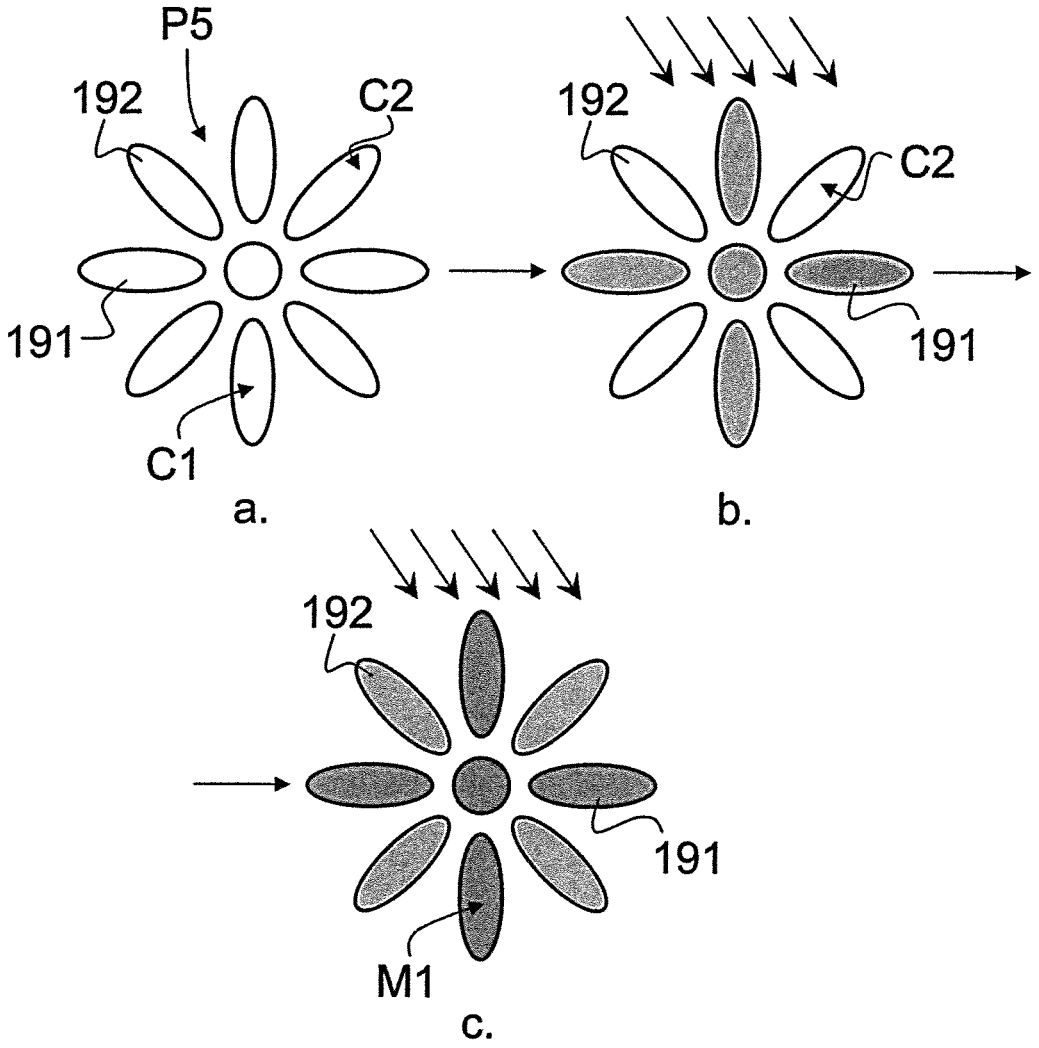
FIG. 14 illustrates a variant of the embodiment shown in FIG. 13 where the resulting appearance of the pattern formed by the dynamic-effect features also produces the impression of a gradual change under exposure to the illumination stimulus.

Other patterns are obviously possible, as for instance illustrated in FIG. 14 where a pattern P5 taking the shape of a flower consisting of first and second dynamic-effect features 191, 192 with different response times (and possibly color appearances) is shown.

Figure 15:
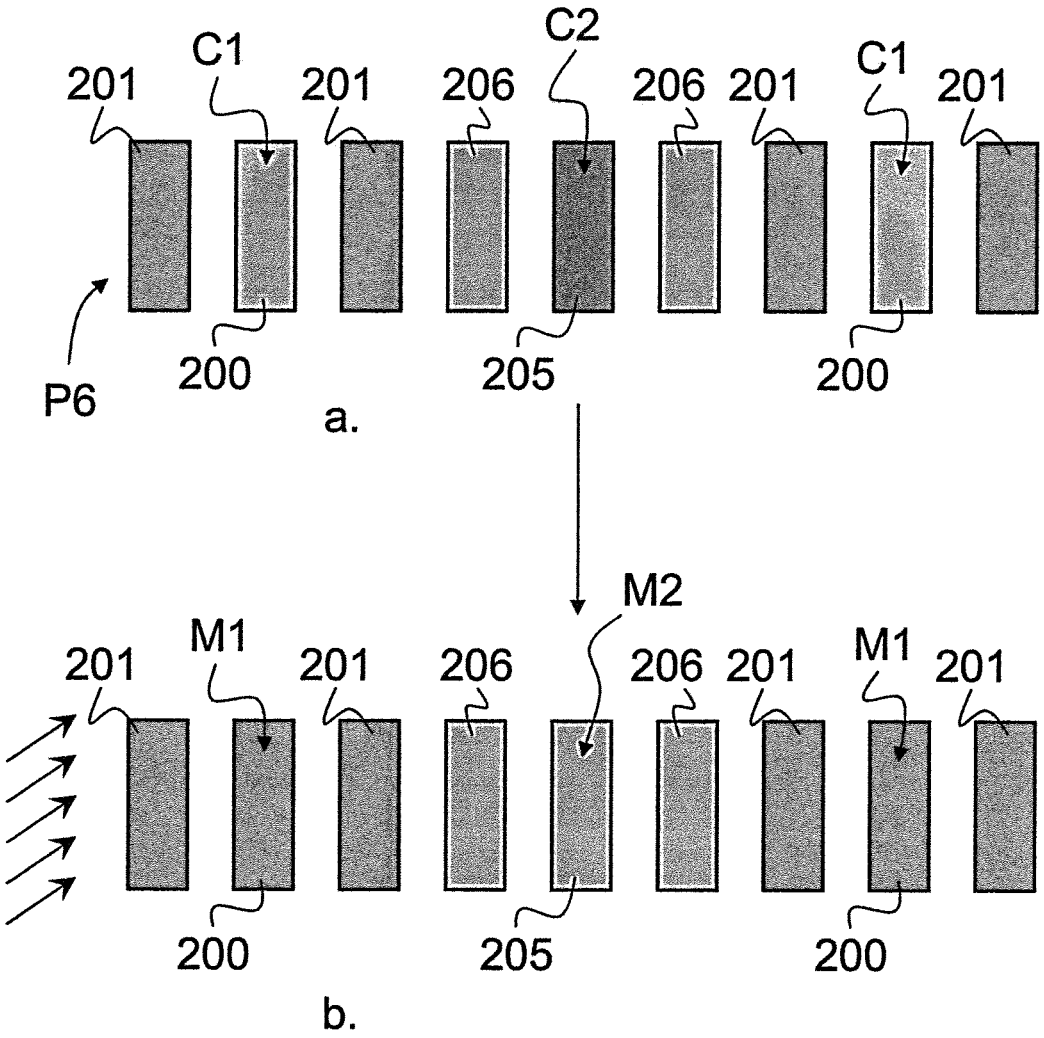
FIG. 15 illustrates yet another embodiment of a security feature in accordance with the invention where first and second dynamic-effect features are applied in corresponding regions proximate or adjacent to proximity features having matching or similar color appearances such that the resulting appearance of the pattern formed by the dynamic-effect features and proximity features produces the impression of a change in spatial frequency under exposure to the illumination stimulus.

FIG. 15 illustrates yet another embodiment of a security feature in accordance with the invention where first and second dynamic-effect features 200, 205 are applied in corresponding regions proximate to first and second proximity features 201, 206 each having a static color appearance, the resulting appearance of the pattern P6 formed by the dynamic-effect features 200, 205 and proximity features 201, 206 producing the impression of a change in spatial frequency under exposure to the illumination stimulus.

To this end, the first dynamic-effect feature 200 is selected to have a contrast color C1 (for instance a red color) and a modulation color M1 (for instance a blue color) that closely matches the static color appearance (e.g. red) of the second proximity feature 206 and the static color appearance (e.g. blue) of the first proximity feature 201, respectively. Conversely, the second dynamic-effect feature 205 is selected to have a contrast color C2 (for instance a blue color) and a modulation color M2 (for instance a red color) that closely matches the static color appearance of the first proximity feature 201 and the static color appearance of the second proximity feature 206, respectively.

In the first state (state a. in FIG. 15), i.e. under ambient visible light, the pattern P6 exhibits alternate red and blue bars with a certain spatial frequency. In the second state (state b. in FIG. 15), following exposure to the illumination stimulus, the first and second dynamic-effect features 200 and 205 turn into their respective modulation colors M1, M2, thereby changing, in appearance, the spatial frequency of the bars forming the pattern P6.

Various modifications and/or improvements may be made to the above-described embodiments without departing from the scope of the invention as defined by the appended claims. For instance, while reference has been made to SMF pigment components, other types of DEPs may be put into practice to obtain similar effects.

In addition, combinations of the above-described embodiments are possible. For instance, in the embodiments of FIGS. 8*a* to 8*d*, it could be envisaged to apply a static fluorescent component in any one of the proximity features surrounding the dynamic-effect feature, which static fluorescent component could exhibit a fluorescent color appearance similar to or closely matching the fluorescent color appearance of the dynamic-effect feature.

LIST OF REFERENCES USED IN THE FIGURES AND SPECIFICATION

10 single pigment particle with dynamic-effect (e.g. SMF pigment particle)

10* coating, impression or like layer incorporating a dynamic-effect component (e.g. an ink or varnish layer incorporating an SMF pigment component)

20 substrate (e.g. paper or plastic substrate of a banknote or like security document)

C contrast color of SMF feature (under ambient visible light)

F fluorescent color of SMF feature (upon initial submission to the illumination stimulus)

M modulation color of SMF feature (following continued steady-state submission to the illumination stimulus)

$\tau_1$ time constant defining the modulation time of a given SMF pigment or feature $\tau_2$ time constant defining the recovery time of a given SMF pigment or feature MD relative modulation depth of the SMF feature, i.e. measure in percentage of the degree of modulation of the fluorescence of the SMF pigment or feature

100 dynamic-effect feature (e.g. SMF feature)

101 first proximity feature having a color appearance similar to or closely matching the second color appearance of the dynamic-effect feature

100 (e.g. the fluorescent color F of the SMF feature)

102 second proximity feature having a color appearance similar to or closely matching the third color appearance of the dynamic-effect feature 100 (e.g. the modulation color M of the SMF feature)

110 dynamic-effect feature (e.g. SMF feature)

110*b* excited region of the dynamic-effect feature 110 upon initial submission to the illumination stimulus and exhibiting the second color appearance (e.g. the fluorescent color F of the SMF feature)

110*c* excited region of the dynamic-effect feature 110 upon continued steady-state submission to the illumination stimulus and exhibiting the third color appearance (e.g. the modulation color M of the SMF feature)

110*d* border region exhibiting the second color appearance, next to the excited region 110*c*, upon dithering of the illumination source

120 dynamic-effect feature (e.g. SMF feature)

120*a* proximity feature (central portion) having a color appearance similar to or closely matching the first color appearance of the dynamic-effect feature 120 (e.g. the contrast color C of the SMF feature)

120*b* proximity feature (external portion) having a color appearance similar to or closely matching the second color appearance of the dynamic-effect feature 120 (e.g. the fluorescent color F of the SMF feature)

121 dynamic-effect feature (e.g. SMF feature)

121*a* proximity feature (central portion) having a color appearance similar to or closely matching the third color appearance of the dynamic-effect feature 121 (e.g. the modulation color M of the SMF feature)

121*b* proximity feature (external portion) having a color appearance similar to or closely matching the third color appearance of the dynamic-effect feature 121 (e.g. the modulation color M of the SMF feature)

122 dynamic-effect feature (e.g. SMF feature)

122*a* proximity feature (central portion) having a color appearance similar to or closely matching the second color appearance of the dynamic-effect feature 122 (e.g. the fluorescent color F of the SMF feature)

122*b* proximity feature (external portion) having a color appearance similar to or closely matching the third color appearance of the dynamic-effect feature 122 (e.g. the modulation color M of the SMF feature)

123 dynamic-effect feature (e.g. SMF feature)

123*a* proximity feature (central portion) having a color appearance similar to or closely matching the first color appearance of the dynamic-effect feature 123 (e.g. the contrast color C of the SMF feature)

123*b* proximity feature (external portion) having a color appearance similar to or closely matching the third color appearance of the dynamic-effect feature 123 (e.g. the modulation color M of the SMF feature)

130 dynamic-effect feature (e.g. SMF feature)

131 first proximity feature having a color appearance similar to or closely matching the first color appearance of the dynamic-effect feature 130 (e.g. the contrast color C of the SMF feature)

132 second proximity feature having a color appearance similar to or closely matching the second color appearance of the dynamic-effect feature 130 (e.g. the fluorescent color F of the SMF feature)

133 third proximity feature having a color appearance similar to or closely matching the third color appearance of the dynamic-effect feature

130 (e.g. the modulation color M of the SMF feature)

135 dynamic-effect feature (e.g. SMF feature with matching contrast and modulation colors C, M)

136 first proximity feature having a color appearance similar to or closely matching the first (and third) color appearance of the dynamic-effect feature 135 (e.g. the contrast color C of the SMF feature)

137 second proximity feature having a color appearance similar to or closely matching the second color appearance of the dynamic-effect feature 135 (e.g. the fluorescent color F of the SMF feature)

140 dynamic-effect feature with transitory fluorescence color appearance F (e.g. SMF feature)

141 proximity feature having a color appearance similar to or closely matching the modulation color M of the dynamic-effect feature 140

142 static fluorescent feature with static fluorescence color appearance F*

P1 predetermined pattern (e.g. "X" shape) formed by features 140, 141, 142

15 line segments including a combination of dynamic-effect features and features having a static contrast color appearance

16 line segments including static fluorescent features

150 dynamic-effect features of line segments 15 with transitory fluorescence color appearance F (e.g. SMF features)

151 features of line segments 15 with static contrast color appearance matching the contrast color C of the dynamic-effect features 150

160 static fluorescent features of line segments 16 with static fluorescence color appearance F*

P2 predetermined pattern (e.g. number "20") formed by features 150, 160

171 first dynamic-effect feature (e.g. SMF feature) with contrast color C1 and modulation color M1

172 second dynamic-effect feature (e.g. SMF feature) with swapped contrast color C2 and modulation color M2 compared to first dynamic-effect feature 171

P3 predetermined pattern (e.g. flower pattern) formed by features 171, 172 and exhibiting a color-swap effect

181 first dynamic-effect feature with first (short) response time

182 second dynamic-effect feature with second (medium) response time

183 third dynamic-effect feature with third (long) response time

P4 predetermined pattern (e.g. bar element pattern) formed by features 181, 182, 183 and exhibiting a gradual change in appearance

191 first dynamic-effect feature with first (short) response time

192 second dynamic-effect feature with second (long) response time

P5 predetermined pattern (e.g. flower pattern) formed by features 191, 192 and exhibiting a gradual change in appearance

200 first dynamic-effect feature (e.g. SMF feature) with (e.g. red) contrast color C1 and (e.g. blue) modulation color M1

201 first proximity feature with static color appearance (e.g. blue)

205 second dynamic-effect feature (e.g. SMF feature) with swapped contrast color C2 and modulation color M2 compared to first dynamic-effect feature 200

206 second proximity feature with static color appearance (e.g. red)

P6 predetermined pattern (e.g. bar element pattern) formed by features 200, 201, 205, 206 and exhibiting an apparent change in spatial frequency

The invention claimed is:

1. A security element or document comprising a substrate and at least a first dynamic-effect feature applied on the substrate, which first dynamic-effect feature includes a dynamic-effect component that is responsive to an illumination stimulus of a selected excitation wavelength or wavelength band to produce an optical spectral response, which optical spectral response changes dynamically over an observable period of time of a few seconds between multiple color appearances upon and while being subjected to the illumination stimulus, wherein the first dynamic-effect feature is applied in a region of the substrate which is proximate or adjacent to at least one proximity feature applied on the substrate, which at least one proximity feature has a color component having a color appearance which is selected to enhance and/or complement at least one of the multiple color appearances of the first dynamic-effect feature;

wherein the at least one proximity feature has a static color appearance that does not change in response to the illumination stimulus, which static color appearance is selected to match at least one of the multiple color appearances of the first dynamic-effect feature.

2. The security element or document as defined in claim 1, wherein the first dynamic-effect feature has a first color appearance under ambient visible light, a second color appearance upon initial submission to the illumination stimulus, and at least a third color appearance upon continued steady-state submission to the illumination stimulus.

3. The security element or document as defined in claim 1, wherein the first dynamic-effect feature is located between a first proximity feature and at least a second proximity feature applied on the substrate, and wherein the second proximity feature has a static color appearance that does not change in response to the illumination stimulus and that is different from the static color appearance of the first proximity feature.

4. The security element or document as defined in claim 3, wherein the color appearance of the second proximity feature matches a different one of the multiple color appearances of the first dynamic-effect feature.

5. The security element or document as defined in claim 3, wherein the color appearance of the first proximity feature matches the second color appearance of the first dynamic-effect feature, wherein the color appearance of the second proximity feature matches the third color appearance of the first dynamic-effect feature, and wherein the first and second proximity features are located on opposite sides of the first dynamic-effect feature, such that submission to the illumination stimulus produces an impression of movement between the first and second proximity features.

6. The security element or document as defined in claim 1, wherein the first dynamic-effect feature has a comparatively small surface area compared to an excited area which may be subjected to the illumination stimulus at a given point in time, so that the entire dynamic-effect feature is subjected to the illumination stimulus.

7. The security element or document as defined in claim 1, wherein the first dynamic-effect feature has a comparatively large surface area compared to an excited area which may be subjected to the illumination stimulus at a given point in time, so that only part of the first dynamic-effect feature is subjected to the illumination stimulus at a given point in time.

8. The security element or document as defined in claim 1, wherein the dynamic-effect component is a self-modulated fluorescent component having a contrast color appearance under ambient visible light, a fluorescent color appearance upon initial submission to the illumination stimulus, and a modulated color appearance upon continued steady-state submission to the illumination stimulus.

9. The security element or document as defined in claim 1, wherein the dynamic-effect component exhibits an initial contrast color appearance when not subjected to the illumination stimulus and wherein the dynamic-effect component reversibly returns to the initial contrast color appearance after a certain recovery time following cessation of the illumination stimulus.

10. The security element or document as defined in claim 1, wherein the at least one dynamic-effect component is responsive to incident electromagnetic radiation in an ultraviolet or infrared spectrum.

11. The security element as defined in claim 1, wherein the security element is a foil element for application onto or embedment into substrates of security documents.

12. The security document as defined in claim 1, wherein the security document is a banknote.

13. A method of confirming authenticity of a security element or document comprising the following steps:

providing a security element or document comprising a substrate and at least a first dynamic-effect feature applied on the substrate, which first dynamic-effect feature includes a dynamic-effect component that is responsive to an illumination stimulus of a selected excitation wavelength or wavelength band to produce an optical spectral response, which optical spectral response changes dynamically over an observable period of time of a few seconds between multiple color appearances upon and while being subjected to the illumination stimulus, wherein the first dynamic-effect feature is applied in a region of the substrate which is proximate or adjacent to at least one proximity feature applied on the substrate, which at least one proximity feature has a color component having a color appearance which is selected to enhance and/or complement at least one of the multiple color appearances of the first dynamic-effect feature, and wherein the at least one proximity feature has a static color appearance that does not change in response to the illumination stimulus, which static color appearance is selected to match at least one of the multiple color appearances of the first dynamic-effect feature, subjecting the security element or document to the illumination stimulus, and observing the optical spectral response of the security element or document in response to the illumination stimulus, which optical spectral response changed dynamically over the observable period of time between the multiple color appearances.

14. The method as defined in claim 13, wherein only a portion of the first dynamic-effect feature is subjected to the illumination stimulus at a given point in time.

15. The method as defined in claim 13, wherein the entire dynamic-effect feature is subjected to the illumination stimulus at a given point in time.

* * * * *